US010494218B2

(12) United States Patent
Nakamura

(10) Patent No.: US 10,494,218 B2
(45) **Date of Patent: *Dec. 3, 2019**

(54) COATING FILM TRANSFER TOOL WITH SUPPLY REEL ROTATION RESTRAINT MECHANISM

(71) Applicant: Tombow Pencil Co., Ltd., Tokyo (JP)

(72) Inventor: Ryo Nakamura, Tokyo (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/539,863

(22) PCT Filed: Jun. 25, 2015

(86) PCT No.: PCT/JP2015/068432

§ 371 (c)(1),
(2) Date: Jun. 26, 2017

(87) PCT Pub. No.: WO2016/103766

PCT Pub. Date: Jun. 30, 2016

(65) Prior Publication Data

US 2017/0369268 A1 Dec. 28, 2017

(30) Foreign Application Priority Data

Dec. 26, 2014 (JP) ..... 2014-264838

(51) Int. Cl.
*B65H 37/00* (2006.01)
*B43L 19/00* (2006.01)

(52) U.S. Cl.
CPC ..... *B65H 37/007* (2013.01); *B43L 19/00* (2013.01); *B43L 19/0068* (2013.01); *B65H 2701/37* (2013.01)

(58) Field of Classification Search
CPC ..... B65H 37/007
See application file for complete search history.

(56) References Cited

U.S. PATENT DOCUMENTS 4,959,046 A * 9/1990 Brunetto ..... B42C 3/00 156/517
5,597,633 A * 1/1997 Mecke ..... C09J 133/08 428/41.5

(Continued)

FOREIGN PATENT DOCUMENTS

EP 427870 A1 5/1991
EP 0427870 A1 5/1991

(Continued)

OTHER PUBLICATIONS

Jun. 27, 2017, International Search Report and Written Opinion of the International Searching Authority from the Japanese Patent Office in PCT/JP2017/011867, which is an international application of Applicant Tombow Pencil Co., Ltd.

(Continued)

*Primary Examiner* — Karl Kurple
(74) *Attorney, Agent, or Firm* — Kolitch Romano LLP

(57) ABSTRACT

A coating film transfer tool may include a supply reel, a transfer tape, a transfer head, a winding reel, and a power transmitting mechanism. The tool may include a base member having the transfer head and a rotation restraining portion capable of directly restraining rotation of the supply reel. The base member may be rotatably supported between the transfer head and the rotation restraining portion by a base member supporting shaft. The tool may include a resilient restoring mechanism interposed between the base member and the housing. The base member may rotate and restraint of rotation of the supply reel is released when the transfer head is pressed against a transferred surface, and the base member is restored to an original position by the resilient restoring mechanism to restrain rotation of the supply reel when pressing of the transfer head is released.

20 Claims, 5 Drawing Sheets

(56) References Cited

U.S. PATENT DOCUMENTS

| | | | | |
|---|---|---|---|---|
| 5,759,341 | A | 6/1998 | Kobayashi | |
| 5,785,437 | A * | 7/1998 | Koyama | B65H 37/007 156/540 |
| 5,792,263 | A * | 8/1998 | Koyama | B65H 37/007 118/200 |
| 5,991,568 | A * | 11/1999 | Ziegelmuller | G03G 21/007 399/102 |
| 6,444,266 | B1 * | 9/2002 | Mizuno | B05D 1/28 427/258 |
| 6,510,884 | B1 * | 1/2003 | Chan | B65H 35/0033 156/527 |
| 7,228,882 | B2 | 6/2007 | Marschand et al. | |
| 9,821,347 | B2 * | 11/2017 | Nakane | B08B 1/006 |
| 9,969,590 | B2 * | 5/2018 | Fujisawa | B65H 37/007 |
| 2002/0088554 | A1 | 7/2002 | Bouveresse et al. | |
| 2009/0026302 | A1 * | 1/2009 | Kinugasa | B65H 37/007 242/410 |
| 2009/0050275 | A1 | 2/2009 | Sakanishi | |
| 2009/0185849 | A1 * | 7/2009 | Narita | B65H 37/007 401/88 |
| 2009/0205785 | A1 | 8/2009 | Rolion et al. | |
| 2010/0084095 | A1 * | 4/2010 | Sekiya | B65H 37/007 156/378 |
| 2011/0244136 | A1 * | 10/2011 | Ryabova | B01F 5/10 427/428.15 |
| 2012/0267047 | A1 * | 10/2012 | Maus | B65H 35/0013 156/306.6 |
| 2014/0318700 | A1 * | 10/2014 | Henderson | B65C 9/1865 156/249 |
| 2017/0247792 | A1 * | 8/2017 | Kobashi | C23C 16/0227 |
| 2018/0015775 | A1 | 1/2018 | Tamura | |

FOREIGN PATENT DOCUMENTS

| | | | |
|---|---|---|---|
| JP | H09-71097 | A | 3/1979 |
| JP | H0288057 | A | 3/1990 |
| JP | 05-178525 | A | 7/1993 |
| JP | 05178525 | A | 7/1993 |
| JP | 06073025 | U | 10/1994 |
| JP | H0971097 | A | 3/1997 |
| JP | 2876301 | B2 | 4/1997 |
| JP | H09-104562 | A | 4/1997 |
| JP | H09104562 | A | 4/1997 |
| JP | H09-124219 | A | 5/1997 |
| JP | H10-52995 | A | 2/1998 |
| JP | H1052995 | A | 2/1998 |
| JP | 10-181289 | A | 7/1998 |
| JP | 10181289 | A | 7/1998 |
| JP | 11-1095 | A | 1/1999 |
| JP | 111095 | A | 1/1999 |
| JP | 2005-47201 | A | 2/2005 |
| JP | 2005047201 | A | 2/2005 |
| JP | 3870986 | B2 | 1/2007 |
| JP | 2011-121204 | A | 6/2011 |
| JP | 2011121204 | A | 6/2011 |
| JP | 2011-245696 | A | 12/2011 |
| JP | 2011245696 | A | 12/2011 |
| JP | 2016-124131 | A | 7/2016 |
| JP | 2016124131 | A | 7/2016 |
| JP | 6247199 | B2 | 12/2017 |

OTHER PUBLICATIONS

Oct. 6, 2015, International Search Report of the International Searching Authority from the Japan Patent Office in PCT/JP2015/068432, which is the international application to this U.S. application.

Oct. 6, 2015, Written Opinion of the International Searching Authority from the Japan Patent Office in PCT/JP2015/068432, which is the international application to this U.S. application.

Japan Patent Office, International Search Report and Written Opinion of the International Searching Authority, dated Oct. 6, 2015, in PCT/JP2015/068432, which is the international application to this U.S. application.

Japan Patent Office, International Search Report and Written Opinion of the International Searching Authority, dated Jun. 27, 2017, in PCT/JP2017/011867, which is the international application to this U.S. application.

Sep. 15, 2015, International Search Report and Written Opinion of the International Searching Authority from the Japan Patent Office in PCT/JP2015/0613430, which is an international application of Applicant Tombow Pencil Co., Ltd.

United States Patent Office, Non-final Office Action dated Apr. 25, 2019 in U.S. Appl. No. 15/534,698, which is a co-pending application of Tombow Pencil Co., Ltd.

* cited by examiner

COATING FILM TRANSFER TOOL WITH SUPPLY REEL ROTATION RESTRAINT MECHANISM

CROSS-REFERENCE TO RELATED APPLICATIONS

This application is a national phase application of PCT/JP2015/068432, filed Jun. 25, 2015, which claims priority to Japanese Patent Application No. 2014-264838, filed Dec. 26, 2014, each of which is hereby incorporated by reference.

TECHNICAL FIELD

The present invention relates to a coating film transfer tool provided with a transfer tape for correction, for adhesion, or the like.

BACKGROUND ART

In general, widely used as a coating film transfer tool is an automatically winding type coating film transfer tool in which a supply reel having a transfer tape wound thereon and a winding reel that winds the transfer tape after use are interlocked via a power transmitting mechanism in a housing, and a rotation torque of the winding reel or the supply reel is generated by a frictional force generated on a sliding surface between components by using a restoring force of a resilient member such as a spring.

When in use, a transfer head is pressed against a transferred surface such as paper and is moved thereon, whereby the transfer tape is drawn out from the supply reel and a coating film of the transfer tape is transferred to the transferred surface.

At the same time as completion of transfer, the coating film transferred to the transferred surface and a coating film on an untransferred transfer tape are cut off by moving the coating film transfer tool away from the transferred surface. In this case, a stringing phenomenon may appear. The stringing phenomenon is a phenomenon in which the coating film is not desirably cut off, and thus the transfer tape is drawn out from the supply reel more than necessary, or part of the coating film transferred to the transferred surface separates. This phenomenon is often caused by a rotation of the supply reel that may occur when the coating film transfer tool is moved away from the transferred surface.

As a countermeasure for this phenomenon, an invention disclosed in PTL 1 describes a configuration in which a rotation preventing member of an arcuate-shaped arm having a spring property is provided integrally with a transfer head, so that the rotation preventing member prevents rotation of a supply reel gear when not in use, and the prevention of rotation of the supply reel gear is released when the transfer head is pressed against the transferred surface for use. However, the rotation preventing member is susceptible to deformation, and thus unintentional release may occur, so that reliability of prevention of rotation is not sufficient.

PTL 2 that is applied by the applicant of the present application describes an invention in which a transfer head having a stopper that engages a winding reel gear is rotatably provided at an end to prevent rotation of the winding reel gear when not in use. However, a supply reel is interlocked with the winding reel gear via a slip mechanism, and thus the supply reel cannot be stopped completely. In addition, with means disclosed in PTL 2, a configuration that prevents the rotation of the supply reel is difficult to achieve.

CITATION LIST

Patent Literatures

PTL 1: JP-A-5-178525
PTL 2: JP-A-11-1095

SUMMARY OF INVENTION

Technical Problem

In view of such circumstances described above, it is an object of the present invention to provide a coating film transfer tool in which a supply reel is reliably restrained from rotating simultaneously with termination of a transfer operation to a transferred surface to ensure cutting of a transfer tape and prevents a stringing phenomenon, and useless movement of a transfer head at the beginning of a transfer operation is reduced as much as possible, so that usage with desirable usability is achieved.

Solution to Problem

According to the present invention, the above-described problem is solved by the following ways.

(1) A coating film transfer tool including at least a supply reel having a transfer tape wound thereon, a transfer head that transfers the transfer tape drawn out from the supply reel to a transferred surface, a winding reel that winds the transfer tape after the transfer, and a power transmitting mechanism that interlocks the supply reel and the winding reel in a housing, the tool including: a base member having the transfer head mounted integrally at a front end thereof and a rotation restraining portion that is capable of directly restraining rotation of the supply reel on a rear half portion thereof, the base member being rotatably supported between the transfer head and the rotation restraining portion by a base member supporting shaft provided at a predetermined position of the housing, a resilient restoring mechanism interposed between the base member and the housing, in which the base member rotates and restraint of rotation of the supply reel is released when the transfer head is pressed against the transferred surface, and the base member is restored to an original position by the resilient restoring mechanism to restrain rotation of the supply reel when pressing of the transfer head is released.

In this configuration, restraint of the rotation of the supply reel is reliably achieved simultaneously with termination of the transfer operation to the transferred surface, so that desirable cut-off of the transfer tape is achieved and the stringing phenomenon is prevented.

(2) In the section (1) described above, the rotation restraining portion of the base member is a locking claw that may lock locked teeth provided on a peripheral edge of a flange formed integrally with the supply reel, when the transfer head is pressed against the transferred surface, the base member is rotated and the locking claw is unlocked from the locked teeth, whereby restraint of rotation of the supply reel is released, and when the transfer head is released from the state of being pressed, the base member is restored to the original position by the resilient restoring mechanism and the locking claw engages the locked teeth, whereby the supply reel is restrained from rotating.

In this configuration, the coating film transfer tool that achieves effects of section (1) described above is easily provided.

(3) In the section (1) or (2) described above, the resilient restoring mechanism includes a spring member mounted between the base member and the housing and configured to urge the base member to rotate in a direction in which a rotation restraining portion of the base member restrains the rotation of the supply reel.

In this configuration, the coating film transfer tool that achieves effects of section (1) described above is easily provided.

(4) In the section (1) or (2) described above, the resilient restoring mechanism brings a spring function portion provided on the base member into abutment with the housing, or a spring function portion provided on the housing into abutment with the base member, thereby urging the base member in a direction in which a rotation restraining portion of the base member restrains the rotation of the supply reel.

In this configuration, the coating film transfer tool that achieves effects of section (1) described above is easily provided.

(5) In any one of the sections (1) to (4) described above, a distance from the base member supporting shaft that supports the base member to a rotation restraining portion provided on a rear half portion of the base member is longer than a distance from a front end of the transfer head provided integrally at a front end of the base member to the base member supporting shaft.

In this configuration, usage with desirable usability is achieved by reducing useless movement of the transfer head at the beginning of the transfer operation as much as possible.

(6) In any one of the sections (1) to (5) described above, the base member is formed into a plate-shaped member, the base member is provided with supporting shaft insertion holes to allow insertion of a supply reel supporting shaft and a winding reel supporting shaft provided on the housing for rotatably supporting the supply reel and the winding reel respectively therethrough, and the supporting shaft insertion holes are formed into a long hole, or a diameter of the supporting shaft insertion holes is increased so as to allow the base member to rotate about the base member supporting shaft in a range required for restraint and release of rotation of the supply reel.

In this configuration, since the base member is a plate-shaped member, the supply reel may be restrained reliably from rotating without being subjected to deformation. In addition, the base member may be rotated without interfering with the supply reel and the winding reel, and desirable responsiveness to the design and dimensions of the housing is achieved without constraining design flexibility of the housing.

Advantageous Effects of Invention

A coating film transfer tool of the present invention has a configuration in which a supply reel is reliably restrained from rotating simultaneously with termination of the transfer operation to a transferred surface to ensure cutting of a transfer tape and prevents a stringing phenomenon, and useless movement of a transfer head at the beginning of a transfer operation is reduced as much as possible, so that usage with desirable usability is achieved.

DETAILED DESCRIPTION OF THE DRAWINGS

An embodiment of the present invention will be described below with reference to the drawings.

Figure 1:
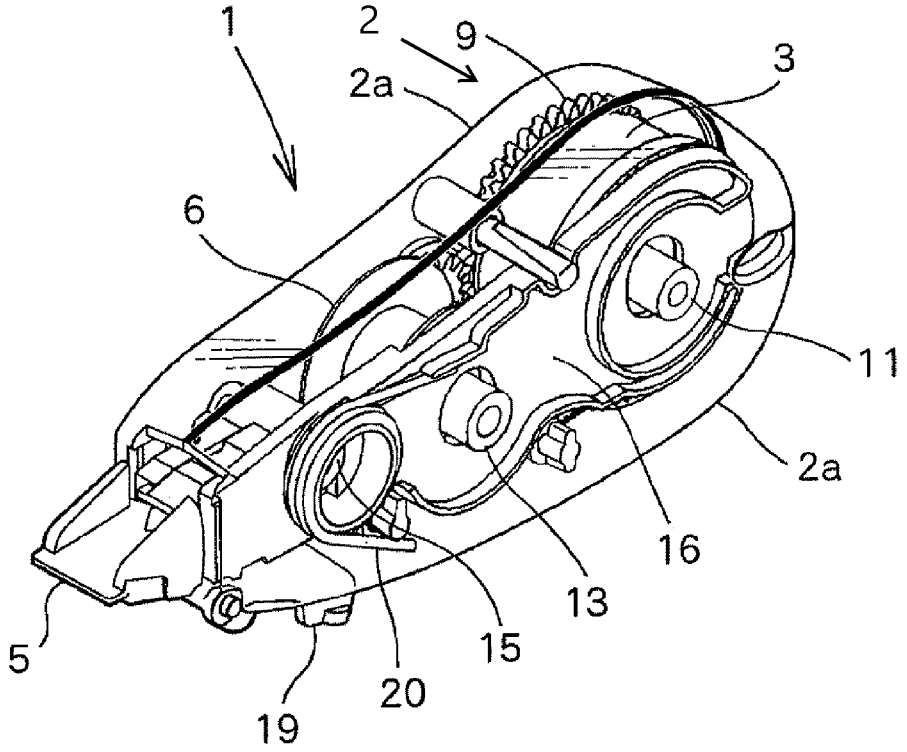
FIG. 1 is an upper perspective view illustrating a coating film transfer tool according to an example of the present invention with a transparent housing.
Figure 2:
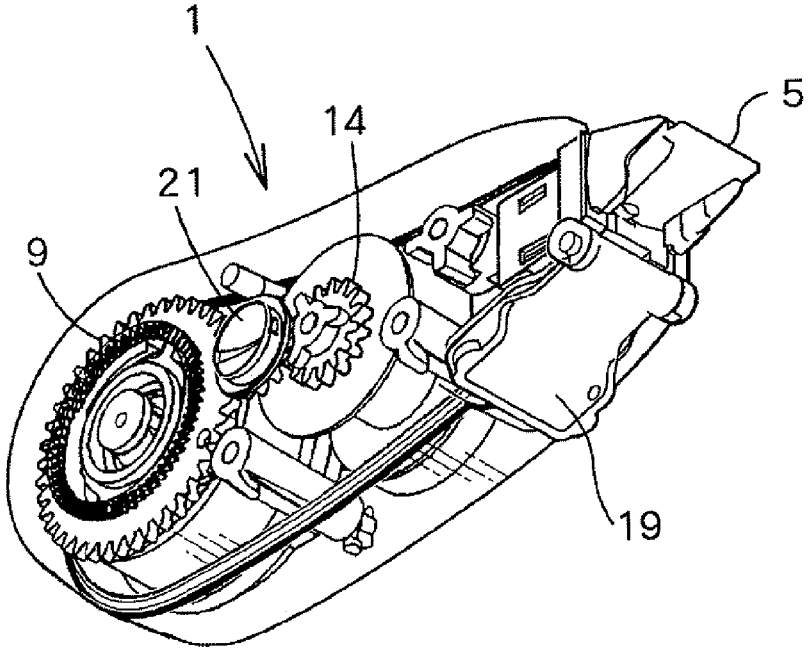
FIG. 2 is a lower perspective view of the same.
Figure 5:
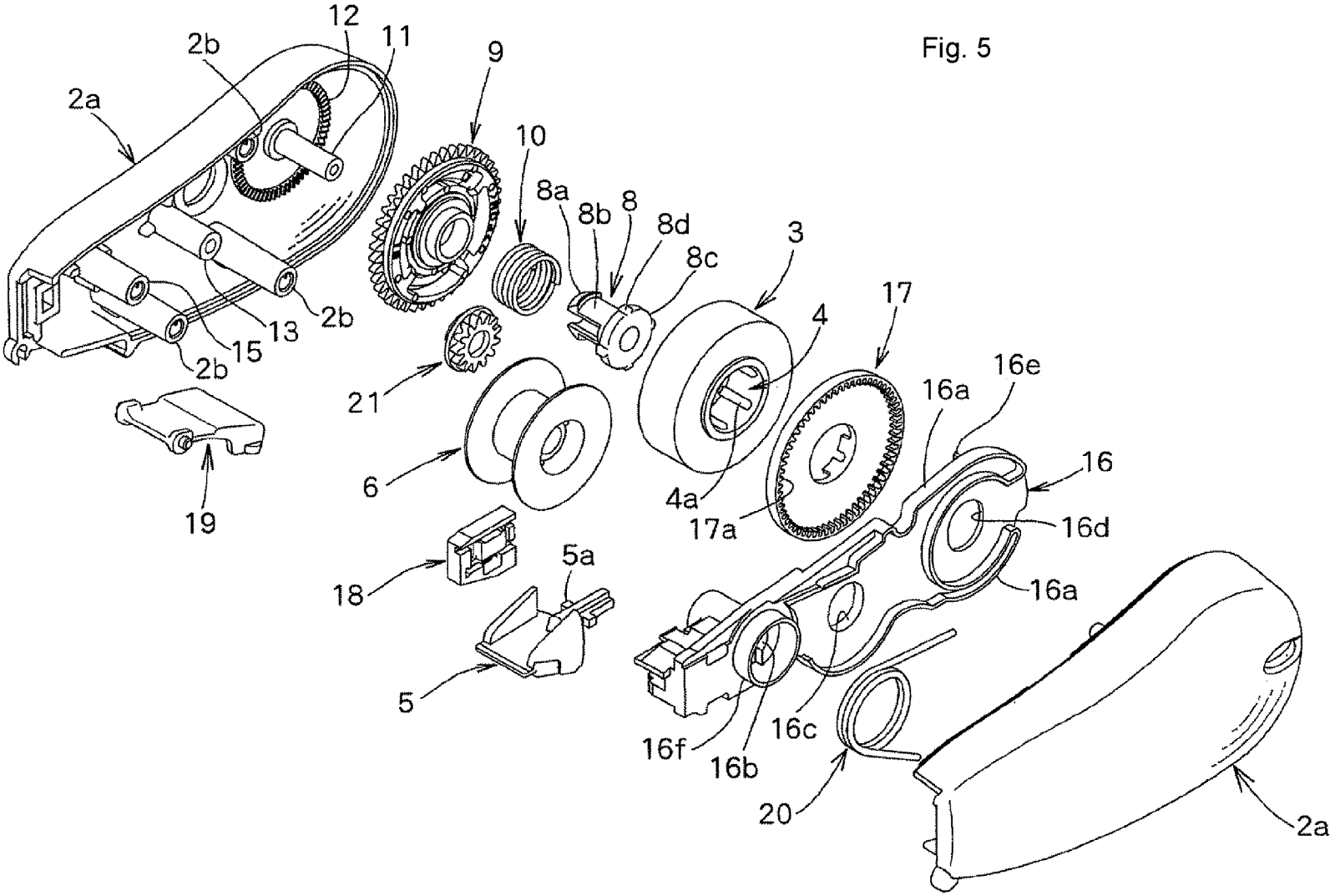
FIG. 5 is an exploded perspective view of the coating film transfer tool viewed from a right upper direction illustrated in a contracted scale.
Figure 6:
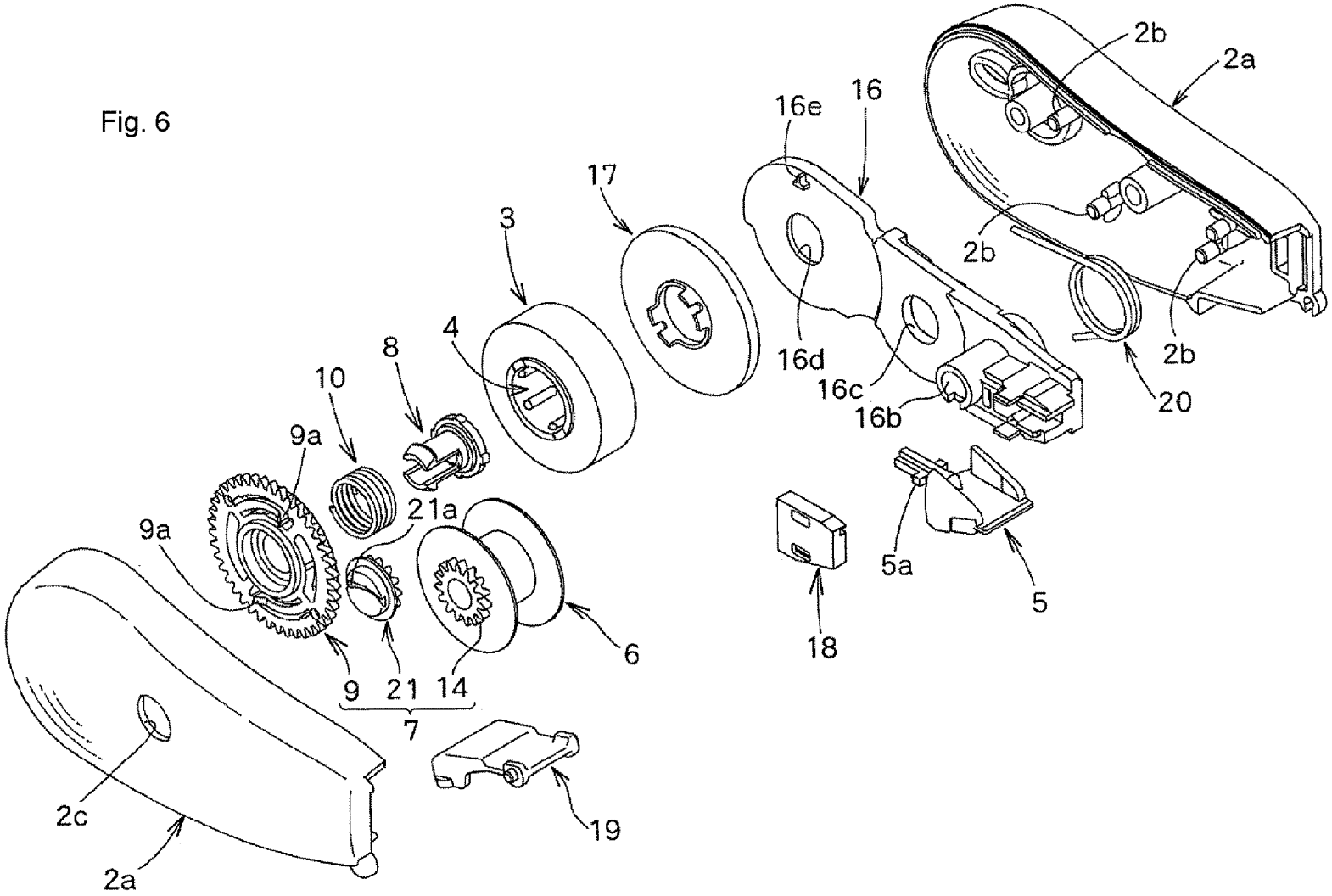
FIG. 6 is an exploded perspective view of the coating film transfer tool viewed from a left upper direction illustrated in a contracted scale.

FIG. 1 is an upper perspective view illustrating a coating film transfer tool 1 according to an example of the present invention with a transparent housing 2, and FIG. 2 is a lower perspective view of the same. FIG. 5 is an exploded perspective view of the coating film transfer tool 1 viewed from a right upper direction illustrated in a contracted scale. FIG. 6 is an exploded perspective view of the same viewed from a left upper direction.

As illustrated in FIGS. 5 and 6, the coating film transfer tool 1 includes a supply reel 4 having a transfer tape 3 wound thereon, a transfer head 5 that transfers the transfer tape 3 drawn out from the supply reel 4 to a transferred surface, a winding reel 6 that winds the transfer tape 3 after transfer, and a power transmitting mechanism 7 that interlocks the supply reel 4 and the winding reel 6 in a housing 2 including a pair of left and right housing members 2*a*. Left and right housing members 2*a* are coupled by joint shafts 2*b* provided upright from the housing members 2*a* to constitute the housing 2.

A supply reel gear 9 is mounted on the supply reel 4 via a stop button 8. The stop button 8 is provided with resilient locking strips 8*b* each having a locking portion 8*a* and head locking portions 8*d* on an outer peripheral surface of a head 8*c*.

A spring 10 and the supply reel gear 9 are fitted over the resilient locking strips 8*b* of the stop button 8 in sequence and are retained by the locking portions 8*a*, and then the stop button 8 is assembled into the supply reel 4 together with the spring 10 and is pivotably supported by a supply reel supporting shaft 11 that is provided upright from the housing members 2*a*. Locking teeth 12 are provided on an inner surface of the housing members 2*a* around the supply reel supporting shaft 11 in a ring shape, resilient ratchet claw 9*a* (see FIG. 6) provided on a rear side of the supply reel gear 9 are locked by the locking teeth 12, so that reverse rotation of the supply reel gear 9 is prevented while using the coating film transfer tool 1.

Rib-shaped locked portions 4*a* extending in a direction of an axis of rotation are provided on an inner surface of the supply reel 4, and the head locking portions 8*d* of the stop button 8 are locked by the rib-shaped locked portions 4*a*, so that the stop button 8 and the supply reel 4 rotate integrally with each other.

The winding reel 6 is pivotably supported by a winding reel supporting shaft 13 that is provided upright on the housing members 2*a*. The winding reel 6 is provided with a winding reel gear 14 attached thereto (see FIG. 6). A small gear 21 is provided between the supply reel gear 9 and the winding reel gear 14, and the small gear 21 engages both of the supply reel gear 9 and the winding reel gear 14.

The small gear 21 is provided with a depressed groove 21*a* that can be operated by a coin and a clip on a surface facing the housing members 2*a*, so that a winding operation for taking up a slack of the transfer tape 3 is enabled from the outside via an operation hole 2*c* of the housing member 2*a*.

The spring 10 assembled into the supply reel 4 is interposed between the head 8*c* of the stop button 8 and the supply reel gear 9 in a compressed state. The winding reel 6 interlocks with the supply reel 4 and generates a rotation torque of the winding reel 6 via a power transmitting mechanism including the supply reel gear 9, the small gear 21, and the winding reel gear 14 by frictional forces generated by a resilient urging force of the spring 10 on a sliding surface between the spring 10 and the head 8*c* of the stop button 8 and a sliding surface between the spring 10 and the supply reel gear 9, whereby a rotation torque of the winding reel 6 is generated.

A remarkable feature of the present invention is in that a base member 16 rotatably supported by a base member supporting shaft 15 is provided at a predetermined position of the housing 2.

The base member 16 is formed of a plate-shaped member elongated in a fore-and-aft direction, and is provided with a reinforcement rib 16*a* on a peripheral edge thereof. The front half portion of the base member 16 is provided with a supporting shaft insertion hole 16*b* for allowing insertion of the base member supporting shaft 15 therethrough, and is provided with supporting shaft insertion holes 16*c*, 16*d* at positions rearward of the base member supporting shaft 15 and on a rear half portion for allowing insertion of the winding reel supporting shaft 13 and the supply reel supporting shaft 11, respectively. The supporting shaft insertion holes 16*d*, 16*c* for allowing insertion of the supply reel supporting shaft 11 and the winding reel supporting shaft 13 are formed into an elongated hole so as to allow the base member 16 to rotate about the base member supporting shaft 15 in a range required for blocking the rotation of the supply reel 4 and releasing the block.

A locking claw 16*e* as a rotation restraining portion for restraining rotation of the supply reel 4 is provided on a side of the base member 16 facing the supply reel 4 as illustrated in FIG. 6.

In contrast, a flange 17 provided with locked teeth 17*a* which the locking claw 16*e* may engage on a peripheral edge is integrally mounted on the supply reel 4. The flange 17 is formed integrally when molding the supply reel 4. In this specification, the expression "the flange 17 is formed integrally with the supply reel 4" includes a case where the flange 17 is mounted on the supply reel 4. As used herein, the expression "integrally formed" means that the supply reel 4 and the flange 17 rotate integrally with each other.

Figure 7:
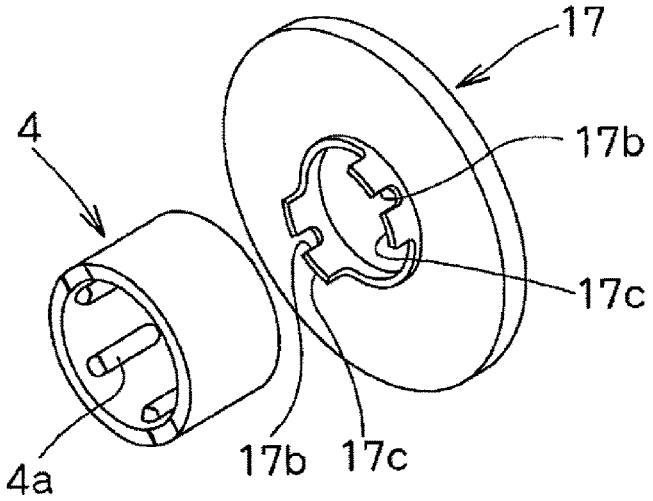
FIG. 7 is an enlarged perspective view of a supply reel and a flange before assembly.
Figure 8:
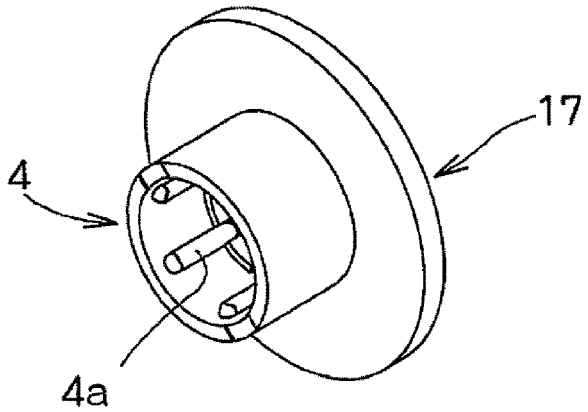
FIG. 8 is an enlarged perspective view of the supply reel and the flange after assembly.
Figure 9:
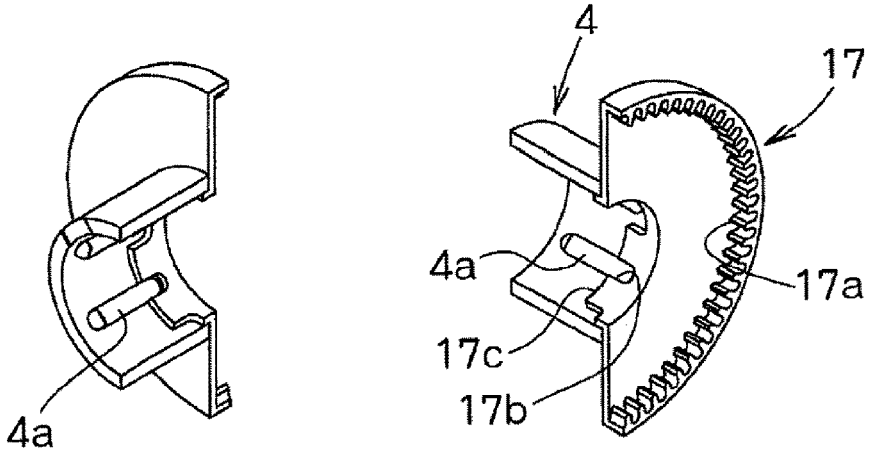
FIG. 9 is an enlarged perspective view of the supply reel and the flange illustrating a state of being divided after assembly.

FIG. 7 is an enlarged perspective view of the supply reel 4 and the flange 17 before assembly. FIG. 8 is an enlarged perspective view of the supply reel 4 and the flange 17 after assembly. FIG. 9 is an enlarged perspective view of the supply reel 4 and the flange 17 illustrating a state of being divided after assembly.

The flange 17 is provided with mounting strips 17*c* each having a notch 17*b* on a back surface thereof. The supply reel 4 and the flange 17 are assembled to each other so as to rotate integrally by locking the rib-shaped locked portions 4*a* of the supply reel 4 to the notches 17*b* of the mounting strips 17*c* as illustrated in FIG. 9.

The transfer head 5 is integrally mounted on a front end of the base member 16. As used herein the expression "integrally mounted" means that the base member 16 is mounted so as to rotate about the base member supporting shaft 15 together with the transfer head 5. In the case where the transfer head 5 is pivotably supported by the base member 16, the transfer head 5 may be rotated integrally with the base member 16.

In this example, the transfer head 5 is mounted on the base member 16 between the base member 16 and a base cover 18 which is mounted to the base member 16 via a pivot 5*a*. A head cover 19 that protects the transfer tape 3 extending over the transfer head 5 is mounted on the housing 2.

The base member 16 is rotatably supported between the transfer head 5 and the locking claw 16*e* as a rotation restraining portion by the base member supporting shaft 15 provided on the housing 2. A spring boss 16*f* is provided in the periphery of the base member supporting shaft 15 for fixing a spring member 20 as a resilient restoring mechanism, which urges the base member 16 so as to rotate in a direction of locking the locking claw 16*e* of the base member 16 to the locked teeth 17*a* of the flange 17.

Figure 3:
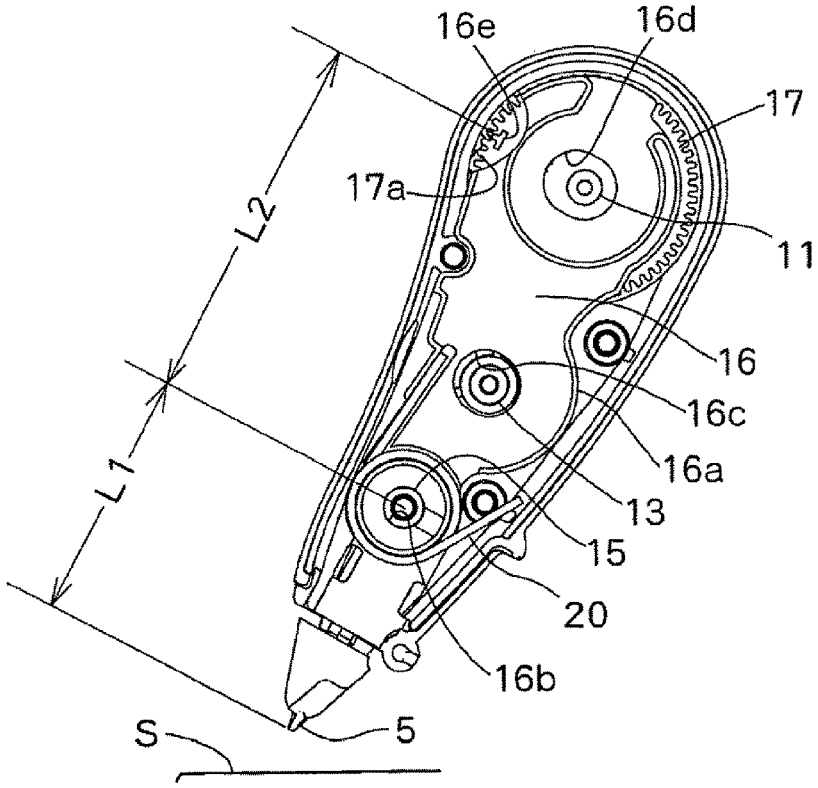
FIG. 3 is a front view of the coating film transfer tool not in use with a base member partly broken.
Figure 4:
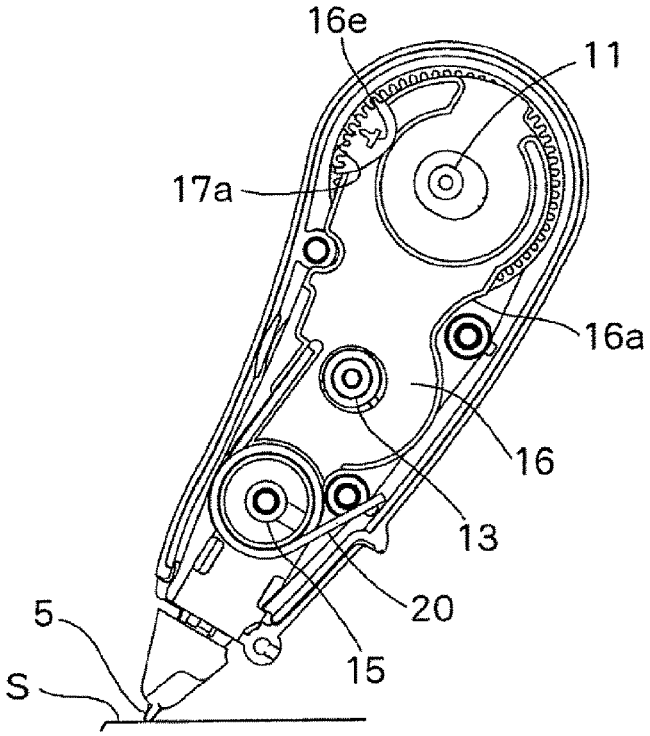
FIG. 4 is a front view of the coating film transfer tool in use with the base member partly broken.

FIG. 3 is a front view of the coating film transfer tool 1 not in use with a base member partly broken. FIG. 4 is a front view of the coating film transfer tool 1 in use with a base member partly broken. FIG. 3 and FIG. 4 illustrate the locking claw 16*e* with the partly broken base member 16.

As illustrated in FIG. 3, the spring member 20 is provided so as to be interposed between the base member 16 and the housing 2. When the coating film transfer tool 1 is not in use, the base member 16 is urged by the spring member 20 in the direction in which the locking claw 16*e* locks the locked teeth 17*a* of the flange 17, and the supply reel 4 that rotates integrally with the flange 17 is directly restrained from rotating. As used in this specification, the expression "the supply reel 4 is directly restrained from rotating" means that the supply reel 4 is restrained from rotating without intermediary of the frictional force.

In contrast, when the coating film transfer tool 1 is used, as illustrated in FIG. 4, pressing the transfer head 5 against a transferred surface S causes the base member 16 to rotate in the direction of unlocking the locking claw 16*e* from the locked teeth 17*a* of the flange 17 and so that rotation of the supply reel 4 is allowed and the transfer tape 3 wound around the supply reel 4 can be drawn out. Also, simultaneously with release of pressing of the transfer head 5, the base member 16 is rotated and is restored to its original position by a resilient restoration force of the spring member 20 to restrain the supply reel 4 from rotating.

A distance L1 from a front end of the transfer head 5 provided integrally with a front end of the base member 16 to the base member supporting shaft 15 is set to be shorter than a distance L2 from the base member supporting shaft 15 to the locking claw 16*e*. Accordingly, the movable extent of the transfer head 5 for unlocking the locking claw 16*e* from the locked teeth 17*a* may be reduced, and thus the coating film transfer tool 1 can be used with desirable usability.

Although the invention has been described in conjunction with the illustrated embodiments, the present invention is not limited thereto. For example, in the example described above, the supporting shaft insertion holes 16*d*, 16*c* of the base member 16 have been described as being an elongated hole. However, the diameter of the supporting shaft insertion holes 16*d*, 16*c* may be increased so that the base member 16 can rotate about the base member supporting shaft 15 by a range required for restraining and releasing the rotation of the supply reel 4. Furthermore, in the embodiment in which the supply reel supporting shaft 11 and the winding reel supporting shaft 13 need not to be inserted through the base member 16, the base member 16 does not have to be provided with the supporting shaft insertion holes.

The reinforcement rib 16*a* in the peripheral edge of the base member 16 is not always necessary, and, for example, a rather thick plate-shaped member or a wavy-plate shaped member may be used for constituting the base member.

Furthermore, the resilient restoring mechanism may have a mode in which the base member is rotated by a spring function part provided on the base member coming into abutment with the housing, or by a spring function part provided on the housing coming into abutment with the base member instead of a mode in which the spring member 20 is interposed between the base member 16 and the housing 2 as in the example described above.

Furthermore, specific shapes of the locked teeth 17*a* of the flange 17 and the locking claw 16*e* of the base member 16 are not specifically limited as long as the supply reel 4 is restrained from rotating in the direction in which the transfer tape 3 wound around the supply reel 4 is drawn.

In one or more embodiments, a coating film transfer tool having a configuration in which a supply reel is restrained from rotating to ensure cutting of a transfer tape and prevent a stringing phenomenon, and useless movement of a transfer head at the beginning of a transfer operation is reduced as much as possible to achieve usage with desirable usability simultaneously with termination of a transfer operation of the transfer tape to a transferred surface is provided.

In one or more embodiments, a base member 16 having the transfer head 5 mounted at a front end and a locking claw 16*e* that is capable of directly restraining rotation of the supply reel on a rear half portion the base member being rotatably supported between the transfer head 5 and the locking claw 16*e* by a base member supporting shaft 15 provided on the housing 2, and a spring member 20 is interposed between the base member 16 and the housing 2. Accordingly the base member 16 rotates and restraint of rotation of the supply reel 4 is released when the transfer head 5 is pressed against the transferred surface S, and the base member 16 is restored to an original position by the spring member 20 to restrain rotation of the supply reel 4 when pressing of the transfer head 5 is released.

The present disclosure may include one or more of the following concepts:

A. A coating film transfer tool including at least a supply reel having a transfer tape wound thereon, a transfer head that transfers the transfer tape drawn out from the supply reel to a transferred surface, a winding reel that winds the transfer tape after the transfer, and a power transmitting mechanism that interlocks the supply reel and the winding reel in a housing, the tool comprising:

a base member having the transfer head mounted integrally at a front end thereof and a rotation restraining portion that is capable of directly restraining rotation of the supply reel on a rear half portion thereof, the base member being rotatably supported between the transfer head and the rotation restraining portion by a base member supporting shaft provided at a predetermined position of the housing, a resilient restoring mechanism interposed between the base member and the housing, wherein the base member rotates and restraint of rotation of the supply reel is released when the transfer head is pressed against the transferred surface, and the base member is restored to an original position by the resilient restoring mechanism to restrain rotation of the supply reel when pressing of the transfer head is released.

B. The coating film transfer tool in accordance with paragraph A, wherein the rotation restraining portion of the base member is a locking claw that may lock a locked teeth provided on a peripheral edge of a flange formed integrally with the supply reel, and when the transfer head is pressed against the transferred surface, the base member is rotated and the locking claw is unlocked from locked teeth, whereby restraint of rotation of the supply reel is released, when the transfer head is released from the state of being pressed, the base member is restored to the original position by the resilient restoring mechanism and the locking claw engages the locked teeth, whereby the supply reel is restrained from rotating.

C. The coating film transfer tool in accordance with paragraphs A or B, wherein the resilient restoring mechanism includes a spring member mounted between the base member and the housing and configured to urge the base member to rotate in a direction in which a rotation restraining portion of the base member restrains the rotation of the supply reel.

D. The coating film transfer tool in accordance with paragraphs A or B, wherein the resilient restoring mechanism brings a spring function portion provided on the base member into abutment with the housing, or a spring function portion provided on the housing into abutment with the base member, thereby urging the base member in a direction in which a rotation restraining portion of the base member restrains the rotation of the supply reel.

E. The coating film transfer tool in accordance with any one of paragraphs A to D, wherein a distance from the base member supporting shaft that supports the base member to a rotation restraining portion provided on a rear half portion of the base member is longer than a distance from a front end of the transfer head provided integrally at a front end of the base member to the base member supporting shaft.

F. The coating film transfer tool in accordance with any one of paragraphs A to E, wherein the base member is formed into a plate-shaped member, the base member is provided with supporting shaft insertion holes to allow insertion of a supply reel supporting shaft and a winding reel supporting shaft provided on the housing for rotatably supporting the supply reel and the winding reel respectively therethrough, and the supporting shaft insertion holes are formed into a long hole, or a diameter of the supporting shaft insertion holes is increased so as to allow the base member to rotate about the base member supporting shaft in a range required for restraint and release of rotation of the supply reel.

REFERENCE SIGN LIST

1 coating film transfer tool
2 housing
2*a* housing member
2*b* joint shaft
2*c* operation hole
3 transfer tape
4 supply reel
4*a* rib-shaped locked portion
5 transfer head

5*a* pivot
6 winding reel
7 power transmitting mechanism
8 stop button
8*a* locking portion
8*b* resilient locking strip
8*c* head
8*d* head locking portion
9 supply reel gear
9*a* resilient ratchet claw
10 spring
11 supply reel supporting shaft
12 locking teeth
13 winding reel supporting shaft
14 winding reel gear
15 base member supporting shaft
16 base member
16*a* reinforcement rib
16*b* supporting shaft insertion hole
16*c* supporting shaft insertion hole
16*d* supporting shaft insertion hole
16*e* locking claw (rotation restraining portion)
16*f* spring boss
17 flange
17*a* locked teeth
17*b* notch
17*c* mounting strip
18 base cover
19 head cover
20 spring member (resilient restoring mechanism)
21 small gear
21*a* depressed groove
S transferred surface

What is claimed is:

1. A coating film transfer tool comprising:

a supply reel having a transfer tape wound thereon and a supply reel gear mounted thereto, wherein the supply reel is rotatable relative to the supply reel gear;

a transfer head that transfers a coating film of the transfer tape drawn out from the supply reel to a transferred surface;

a winding reel configured to wind the transfer tape after a transfer of the coating film to the transferred surface, the winding reel having a winding reel gear attached thereto;

a power transmitting mechanism comprising the supply reel gear coupled to the winding reel gear, configured such that the power transmitting mechanism interlocks the supply reel and the winding reel in a housing;

a base member of the tool having the transfer head mounted integrally at a front end thereof and a rotation restraining portion comprising a locking claw configured to directly restrain rotation of the supply reel on a rear half portion thereof, the base member being rotatably supported between the transfer head and the rotation restraining portion by a base member supporting shaft provided at a predetermined position of the housing; and a resilient restoring mechanism interposed between the base member and the housing, wherein the resilient restoring mechanism comprises a spring member;

wherein the base member rotates and a restraint of rotation of the supply reel by the locking claw is released when the transfer head is pressed against the transferred surface, and the base member is restored to an original position by the resilient restoring mechanism to restrain rotation of the supply reel using the locking claw when pressing of the transfer head is released.

2. The coating film transfer tool according to claim 1, wherein the locking claw is configured to engage with teeth provided on a peripheral edge of a flange formed integrally with the supply reel, and when the transfer head is pressed against the transferred surface, the base member is rotated and the locking claw is disengaged from the teeth, whereby restraint of rotation of the supply reel is released, when the transfer head is released from a state of being pressed, the base member is restored to the original position by the resilient restoring mechanism and the locking claw engages the teeth, whereby the supply reel is restrained from rotating.

3. The coating film transfer tool according to claim 1, wherein the spring member of the resilient restoring mechanism comprises a torsion spring mounted between the base member and the housing and configured to urge the base member to rotate in a direction in which a rotation restraining portion of the base member restrains the rotation of the supply reel.

4. The coating film transfer tool according to claim 1, wherein the resilient restoring mechanism brings a spring function portion provided on the base member into abutment with the housing, thereby urging the base member in a direction in which a rotation restraining portion of the base member restrains the rotation of the supply reel.

5. The coating film transfer tool according to claim 1, wherein a distance from the base member supporting shaft that supports the base member to the rotation restraining portion provided on the rear half portion of the base member is longer than a distance from a front end of the transfer head to the base member supporting shaft.

6. The coating film transfer tool according to claim 1, wherein the base member is formed in the shape of a plate-shaped member, the base member includes supporting shaft insertion holes configured to allow insertion of a supply reel supporting shaft and a winding reel supporting shaft provided on the housing for rotatably supporting the supply reel and the winding reel respectively therethrough, and the supporting shaft insertion holes have an elongated shape, such that the supporting shaft insertion holes are configured to allow the base member to rotate about the base member supporting shaft in a range required for restraint and release of rotation of the supply reel.

7. The coating film transfer tool according to claim 2, wherein the spring member of the resilient restoring mechanism comprises a torsion spring mounted between the base member and the housing and configured to urge the base member to rotate in a direction in which a rotation restraining portion of the base member restrains the rotation of the supply reel.

8. The coating film transfer tool according to claim 7, wherein the resilient restoring mechanism brings a spring function portion provided on the base member into abutment with the housing, thereby urging the base member in a direction in which a rotation restraining portion of the base member restrains the rotation of the supply reel.

9. The coating film transfer tool according to claim 8, wherein a distance from the base member supporting shaft that supports the base member to the rotation restraining portion provided on the rear half portion of the base member is longer than a distance from a front end of the transfer head to the base member supporting shaft.

10. The coating film transfer tool according to claim 9, wherein the base member is formed in the shape of a plate-shaped member, the base member includes supporting shaft insertion holes configured to allow insertion of a supply reel supporting shaft and a winding reel supporting shaft provided on the housing for rotatably supporting the supply reel and the winding reel respectively therethrough, and the supporting shaft insertion holes have an elongated shape, such that the supporting shaft insertion holes are configured to allow the base member to rotate about the base member supporting shaft in a range required for restraint and release of rotation of the supply reel.

11. The coating film transfer tool according to claim 1, wherein the base member is formed in the shape of a plate-shaped member, the base member includes supporting shaft insertion holes configured to allow insertion of a supply reel supporting shaft and a winding reel supporting shaft provided on the housing for rotatably supporting the supply reel and the winding reel respectively therethrough, and a diameter of the supporting shaft insertion holes is enlarged with respect to the supply reel and winding reel supporting shafts so as to allow the base member to rotate about the base member supporting shaft in a range required for restraint and release of rotation of the supply reel.

12. The coating film transfer tool according to claim 1, wherein the resilient restoring mechanism brings a spring function portion provided on the housing into abutment with the base member, thereby urging the base member in a direction in which a rotation restraining portion of the base member restrains the rotation of the supply reel.

13. The coating film transfer tool according to claim 7, wherein the resilient restoring mechanism brings a spring function portion provided on the housing into abutment with the base member, thereby urging the base member in a direction in which a rotation restraining portion of the base member restrains the rotation of the supply reel.

14. The coating film transfer tool according to claim 1, wherein the power transmitting mechanism further comprises a gear that engages both the supply reel gear and the winding reel gear.

15. A coating film transfer tool comprising:

a supply reel having a transfer tape wound thereon and a supply reel gear mounted thereto;

a transfer head that transfers a coating film of the transfer tape drawn out from the supply reel to a transferred surface;

a winding reel configured to wind the transfer tape after a transfer of the coating film to the transferred surface, the winding reel having a winding reel gear attached thereto, wherein the winding reel and the supply reel have a same rotational direction;

a power transmitting mechanism comprising the supply reel gear coupled to the winding reel gear, configured such that the power transmitting mechanism interlocks the supply reel and the winding reel in a housing;

a base member of the tool having the transfer head mounted integrally at a front end thereof and a rotation restraining portion comprising a locking claw configured to directly restrain rotation of the supply reel on a rear half portion thereof, the base member being rotatably supported between the transfer head and the rotation restraining portion by a base member supporting shaft provided at a predetermined position of the housing; and a resilient restoring mechanism interposed between the base member and the housing, wherein the resilient restoring mechanism comprises a spring member;

wherein the base member rotates and a restraint of rotation of the supply reel by the locking claw is released when the transfer head is pressed against the transferred surface, and the base member is restored to an original position by the resilient restoring mechanism to restrain rotation of the supply reel using the locking claw when pressing of the transfer head is released.

16. The coating film transfer tool according to claim 15, wherein the locking claw is configured to engage with teeth provided on a peripheral edge of a flange formed integrally with the supply reel, and when the transfer head is pressed against the transferred surface, the base member is rotated and the locking claw is disengaged from the teeth, whereby restraint of rotation of the supply reel is released, when the transfer head is released from a state of being pressed, the base member is restored to the original position by the resilient restoring mechanism and the locking claw engages the teeth, whereby the supply reel is restrained from rotating.

17. The coating film transfer tool according to claim 15, wherein the spring member of the resilient restoring mechanism comprises a torsion spring mounted between the base member and the housing and configured to urge the base member to rotate in a direction in which a rotation restraining portion of the base member restrains the rotation of the supply reel.

18. The coating film transfer tool according to claim 15, wherein the resilient restoring mechanism brings a spring function portion provided on the base member into abutment with the housing, thereby urging the base member in a direction in which a rotation restraining portion of the base member restrains the rotation of the supply reel.

19. The coating film transfer tool according to claim 15, wherein a distance from the base member supporting shaft that supports the base member to the rotation restraining portion provided on the rear half portion of the base member is longer than a distance from a front end of the transfer head to the base member supporting shaft.

20. The coating film transfer tool according to claim 15, wherein the base member is formed in the shape of a plate-shaped member, the base member includes supporting shaft insertion holes configured to allow insertion of a supply reel supporting shaft and a winding reel supporting shaft provided on the housing for rotatably supporting the supply reel and the winding reel respectively therethrough, and the supporting shaft insertion holes have an elongated shape, such that the supporting shaft insertion holes are configured to allow the base member to rotate about the base member supporting shaft in a range required for restraint and release of rotation of the supply reel.

* * * * *